United States Patent [19]

Henders

[11] 4,456,054

[45] Jun. 26, 1984

[54] METHOD AND APPARATUS FOR HORIZONTAL CONTINUOUS CASTING

[75] Inventor: Siegfried Henders, Geldern, Fed. Rep. of Germany

[73] Assignee: Mannesmann Aktiengesellschaft, Dusseldorf, Fed. Rep. of Germany

[21] Appl. No.: 242,609

[22] Filed: Mar. 11, 1981

[30] Foreign Application Priority Data

Mar. 11, 1980 [DE] Fed. Rep. of Germany ..... 3009189

[51] Int. Cl.[3] ..... B22D 11/16; B22D 11/00

[52] U.S. Cl. ..... 164/454; 164/413; 164/440; 164/466; 164/490; 164/502

[58] Field of Search ..... 164/440, 490, 454, 467, 164/468, 413, 155, 505, 502, 503

[56] References Cited

U.S. PATENT DOCUMENTS

| | | | |
|---|---|---|---|
| 3,857,437 | 12/1974 | Watts | 164/440 |
| 3,976,117 | 8/1976 | Olsson | 164/417 |
| 4,137,961 | 2/1979 | Mola | 164/468 |
| 4,146,078 | 3/1979 | Rummel | 164/490 |
| 4,195,685 | 4/1980 | Sladkoshteev | 164/440 |
| 4,244,420 | 1/1981 | Dain | 164/440 |

FOREIGN PATENT DOCUMENTS

| | | | |
|---|---|---|---|
| 2756112 | 6/1978 | Fed. Rep. of Germany | 164/440 |
| 2423284 | 12/1979 | France | 164/504 |

*Primary Examiner*—Nicholas P. Godici
*Assistant Examiner*—Richard K. Seidel
*Attorney, Agent, or Firm*—Mandeville and Schweitzer

[57] ABSTRACT

A horizontal continuous casting method and apparatus is disclosed. Liquid metal, held in a storage container, is continuously maintained at a height not less than the height of the continuous casting mold. Additionally, adjustment of the relative positions with respect to one another of a magnetic coil surrounding a portion of the continuous casting mold, the storage container, in both the horizontal and vertical directions and the drain pipe extending from the storage container into the continuous casting mold is disclosed.

18 Claims, 2 Drawing Figures

METHOD AND APPARATUS FOR HORIZONTAL CONTINUOUS CASTING

BACKGROUND OF THE INVENTION AND DESCRIPTION OF THE PRIOR ART

The invention relates to a method and an apparatus especially advantageous for horizontal continuous casting of liquid metals, particularly steel, in which the casting metal, flowing in a cooled horizontal continuous casting cast-iron mold, is under the influence of gravitational forces of the liquid metal contained in the storage container and, furthermore, is subject to electromagnetically produced forces. The electro-magnetically produced forces affect the casting metal in the direction of the metal strand casting.

The present invention, by utilizing horizontal continuous casting in contrast to the prior art vertical, vertical with a bending mechanism or semi-horizontal continuous casting makes unnecessary both bending of the cooling metal strand casting from the normal vertical axis into the horizontal axis, as well as the expenditure of high finances, incident to high building structures normally associated with vertical continuous casting. The fully horizontal casting apparatus and process of the present invention eliminate all bending forces normally incident to vertical continuous casting processes having deflection means after casting.

A fully horizontal continuous casting method and apparatus, as compared to the greater capital expenditure inherent in erecting a structure for a vertically arranged continuous casting apparatus, nevertheless has heretofore encountered certain technical difficulties which originate, in particular, from the horizontal position of the casting strand during the cooling period of the casting metal. More specifically, the prior art horizontal casting apparatus and methods do not fully eliminate the possibility that the hollow space, a result of the pulling off and solidification of the casting metal strand, will not be refilled with liquid metal. Additionally, conventional horizontal continuous castings methods and apparatus cannot insure, in contrast to vertical continuous casting methods and apparatus, that the hollow space formed as the liquid metal first leaves the water-cooled mold, will be continuously shifted into the upper cross sectional area of the casting strand and continuously filled. The hollow spaces, if they are not filled in, are subject to a certain asymmetry in separating and settling operations and result in metal products containing inherent failure possibilities.

The conventional apparatus for horizontal strand casting evince several other disadvantages. For example, conventional horizontal continuous casting apparati work on the principle of pulling out the liquid metal strand such that the liquid casting metal is continuously replenished in the horizontal continuous casting cast-iron mold from the storage container. In such apparati the mechanical connection or conduit between the storage container and the horizontal continuous casting cast-iron mold is always a critical element. Depending upon the specific alloy elements of the liquid casting metal and other factors, the casting temperature of the liquid metal may be above 1500° C. The occurrence of such relative high temperatures in connection with continuously used apparatus elements, such as, for example, the storage container, the conduit or drain pipe, the horizontal continuous casting cast-iron mold, necessarily means that the elements must be easily accessible for potentially frequent repair work. The mechanical elements of the conventional horizontal continuous casting installations are difficult to repair and/or modify. The present invention is extremely simple to repair and/or modify. On the other hand, metallurgical requirements do not permit the total simplification of the apparatus elements to such an extent that, for example, the casting metal is simply guided from the storage container into the continuous casting cast-iron mold through troughs open at the top. A degree of complexity of apparatus elements is necessarily inherent in continuous casting of metallurgical products under tightly controlled conditions. The present invention, more fully explained hereinafter, accomplishes both of the just mentioned goals in a mutually consistent manner, i.e., it is easy to repair and the transfer of liquid metal from storage container to mold is not open to the atmosphere. A precisely adjustable set of interconnected apparatus elements are provided for continuous horizontal casting of metallurgical products which elements, however, can be quickly and simply repaired or replaced, as required.

In German reference DE-AS No. 1,296,747 the suggestion is made to provide a horizontal supply line or conduit between a liquid metal storage container, from which the supply of liquid metal originates, and the horizontal continuous casting cast-iron mold; the conduit being provided, around its periphery, with a magnetic pump. The desired purpose of the magnetic pump is to maintain a steady pressure of the liquid metal in the horizontal continuous casting cast-iron mold. The steady pressure of liquid metal in the casting mold produces a high filling content of liquid metal in the interior of the horizontal continuous casting cast-iron mold, thereby tending to reduce the existence of internal voids in the finished metal product. Additionally, the pressure of the liquid metal in the horizontal continuous casting cast-iron mold, by being maintained, allows the heat exchange between the liquid casting metal and the interior walls of the horizontal continuous casting cast-iron mold to be regulated, thereby enhancing simplified and more uniform solidification.

The conventional method of continuous casting of liquid metal operates mostly in air-tight conditions so that the negative effects of reoxidation of the liquid casting metal is eliminated or reduced. The apparatus disclosed in the above identified German reference, by providing a horizontal supply conduit between the horizontal continuous casting cast-iron mold and the storage container, the conduit being manufactured of heat-resistant material, results in a relative high heat loss and an unfavorably long travel distance for the liquid metal. The apparatus disclosed therein is relatively difficult to adjust while in operation and is susceptible to breakdown and other problems.

SUMMARY OF THE INVENTION

A specific object sought to be accomplished by the present invention is to horizontally cast liquid casting metal, thereby eliminating the known disadvantages of vertical continuous casting processes and apparatus. Another specific object sought to be accomplished by the present invention is the horizontal casting of liquid metal over a short distance between storage container and casting mold, thereby substantially eliminating or reducing to a minimum heat loss inherent in long supply conduits. Other objects of the present invention include the casting of large quantities of metal strands per unit time and increasing the degree of filling, i.e., reducing voids for horizontal continuous casting for larger mold cross sections. An object also sought to be accomplished is the creation of structural independence between the liquid metal storage container and the horizontal continuous casting cast-iron mold to thereby achieve easy adjustability and accessibility. Thus, repair, replacement and modification of the horizontal continuous casting cast-iron mold and other apparatus elements can be easily accomplished.

The present invention accomplishes the above described objects by providing that the level of the liquid metal in the storage container be continuously maintained at least as high as the height of the highest point of the inner surface wall of the continuous casting mold cross section at its upstream-directed opening. The opening is normally maintained in an open position during the casting process. Additionally, electro-magnetic forces are provided around the periphery of the continuous casting mold by coaxially located magnetic coils. The electro-magnetic forces, occurring along the length of the horizontal continuous casting cast-iron mold, are continuously, during casting, regulated. In this manner, the equilibrium position of the trailing or upstream end of the liquid metal, in the open cross section of the horizontal continuous casting cast-iron mold, is maintained while the casting strand is continuously pulled off in the opposite direction.

A significant advantage of the present invention resides in the recognition that the liquid metal quantity in the storage container counteracts the continuous pulling off of casting metal strands, thereby eliminating or reducing interior voids in the metal product. Additionally, controlling the liquid metal pressure in the longitudinal section within the horizontal continuous casting cast-iron mold by the electro-magnetic forces simultaneously produces counter-effective forces to the pressure of the liquid metal column in the storage container. Even though the horizontal continuous casting cast-iron mold, during the casting operation, is maintained in an open position at the upstream directed opening, it is possible on the basis of the proposed method to supply the casting metal in large quantities and in a very simple manner without accidental spill-off. Yet, the supply conduit between the storage container and the mold is relatively short so that a comparatively exacting temperature control gradient during casting can be maintained. This is, indeed, a significant improvement over the prior art.

Furthermore, pursuant to the casting process performed in accordance with the teachings of the present invention, the casting metal is not exposed to reoxidation, since it is not, during casting, exposed to atmospheric oxygen. The inventive apparatus and method allows for relatively trouble-free supply of the liquid metal into the horizontal continuous casting cast-iron mold.

Finally, the present invention allows for the near-ideal coordination and adjustment of liquid metal pressure, casting velocity and electro-magnetic force within the horizontal continuous casting cast-iron mold by having various adjustment features.

The liquid metal pressure within a longitudinal section of the horizontal continuous casting cast-iron mold, during the cooling process, can be adjusted and maintained by regulating the casting level of liquid metal in the storage container at least as high as the height of the inside wall surface of the horizontal continuous casting cast-iron mold. Alternatively, the bottom level of molten liquid metal in the storage container is maintained at a multiple of the cross sectional distance of the casting mold above the lowermost height of the inside wall surface of the mold.

In order to further enhance the operating characteristics of the present invention, the electro-magnetic forces of the magnetic coil can be adjusted higher than the equilibrial force and, consequently, be regulated to provide the desired casting velocity. The electro-magnetically produced forces counteract the liquid metal pressure within the storage container so that the liquid metal flow from the storage container can be increased, slowed or completely stopped within desired limits.

The apparatus for carrying out the method according to the present invention basically comprises a liquid metal storage container located adjacent to a horizontal continuous casting cast-iron mold; the elements being connected together by a relatively short drain pipe. A magnetic coil extending around the casting strand axis is also provided.

The apparatus of the present invention is provided with a horizontally extending drain pipe, extending from the storage container and into the casting mold. The drain pipe is equipped with a longitudinal section which at least in part extends into the horizontal continuous casting cast-iron mold. The magnetic coil extends around the casting mold and overlaps at least a portion of the longitudinal section of the drain pipe located within the horizontal continuous casting cast-iron mold. The apparatus thus provides structural independence between the storage container and the horizontal continuous casting cast-iron mold, both of which are subject to continuous relative adjustability when the apparatus is in operation. Furthermore, this arrangement solves, for the first time, the problem of the formation and seepage, in an upstream direction, of a liquid metal trailing end from the horizontal continuous casting cast-iron mold, i.e., the apparatus avoids horizontal leakage of liquid metal from the upstream directed opening of the horizontal continuous casting cast-iron mold.

As a further improvement of the apparatus, the magnetic coil can protrude or extend beyond the upstream directed opening of the horizontal continuous casting cast-iron mold. This feature insures that the liquid metal trailing end will not reach the edge of the rearwardly directed opening of the horizontal continuous casting cast-iron mold.

The adjustment of the position of formation of the liquid metal trailing end and, simultaneously, the thickness of the formed strand shell at the exit of the horizontal continuous casting cast-iron mold is facilitated by allowing the magnetic coil to be selectively positioned by being movable along the direction of the strand axis.

The desired magnitude of the magnetic or induction field of the magnetic coil in the area located between the inside wall surface of the horizontal continuous casting cast-iron mold and the outside wall surface of the drain or feeding pipe extending from the storage container, is facilitated by the formation of an annular ring-shaped slot existing between the exterior of the drain pipe and the interior surface of the horizontal continuous casting cast-iron mold. The electrical induction forces are advantageously effective since heat, associated with the forces, is supplied thereby avoiding solidification in the annular ring-shaped space. The ring thus serves as a gasket-type seal.

The formation of the metal strand shell within the horizontal continuous casting cast-iron mold is achieved since the drain pipe has, at least in its opening area extending into the casting mold, a tapered outer contour, tapering in the downstream direction. This configuration insures that the tapered drain pipe will always be surrounded by liquid metal, thereby not impairing the formation of solidified zones.

As a further aspect of the present invention, the storage container is selectively adjustable along the upstream and downstream strand axis. The relative upstream and downstream adjustability of the storage container is in relation to the horizontal continuous casting cast-iron mold. The horizontal adjustability of the storage container also allows it to be removed quickly from the horizontal continuous casting cast-iron mold or, as required, to be replaced immediately prior to the casting process. The present invention insures complete independent accessability of both the horizontal continuous casting cast-iron mold and the storage container.

Uniform cooling conditions for the liquid metal are also achieved by the fact that the storage container is vertically adjustable. The vertical adjustability also allows the level of the liquid metal to be raised to the proper height with respect to the casting mold without the addition of additional liquid metal.

Finally, the present invention can be employed for a plurality of horizontal continuous casting installations to provide many metal strands of simultaneous output. If this is desired, the storage container is configured as a distribution vessel for the liquid metal. From there the metal is simultaneously directed to many strand casting molds, each of which is provided with drain pipes and magnetic coils.

DETAILED DESCRIPTION OF THE INVENTION

Figure 1:
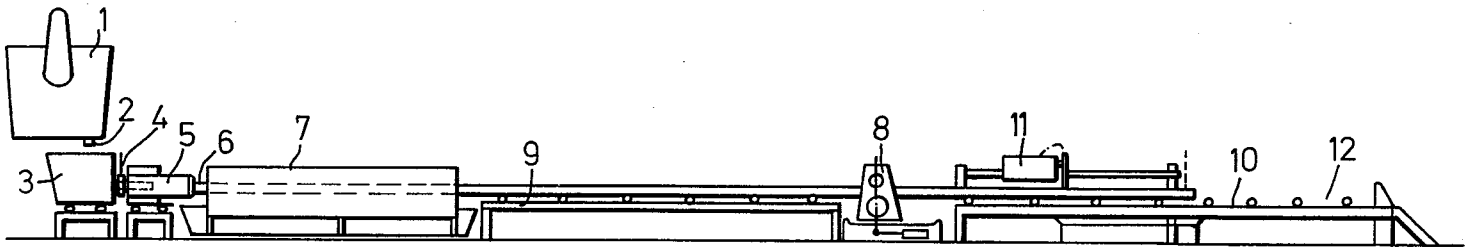
FIG. 1 is a side view of a complete horizontal continuous casting installation.

The horizontal continuous casting installation (FIG. 1) is supplied with liquid metal, preferably steel, from the casting ladle 1 via its pouring nozzle 2. The liquid metal, such as, for example, steel, at a temperature of over 1500° C., is received by the storage container 3. The closure 4 closes off the drain pipe 13 (see FIG. 2) and selectively serves to permit or block the flow of fluid metal into the horizontal continuous casting iron-cast mold 5. The casting strand 6 formed within the horizontal continuous casting cast-iron mold 5, is extensively cooled as it progresses through the cooling zone 7 while being pulled and transported by means of the driving structure 8. The driving structure 8 conveys the cooling metal strand over the roller bed 9 and onto a downstream roller bed 10. The cooled metal strand is sequentially cut into sectional lengths by means of the flame cutter 11. The sectioned lengths of cast metal are directed to a further processing operation by the cross-conveyor section 12.

Figure 2:
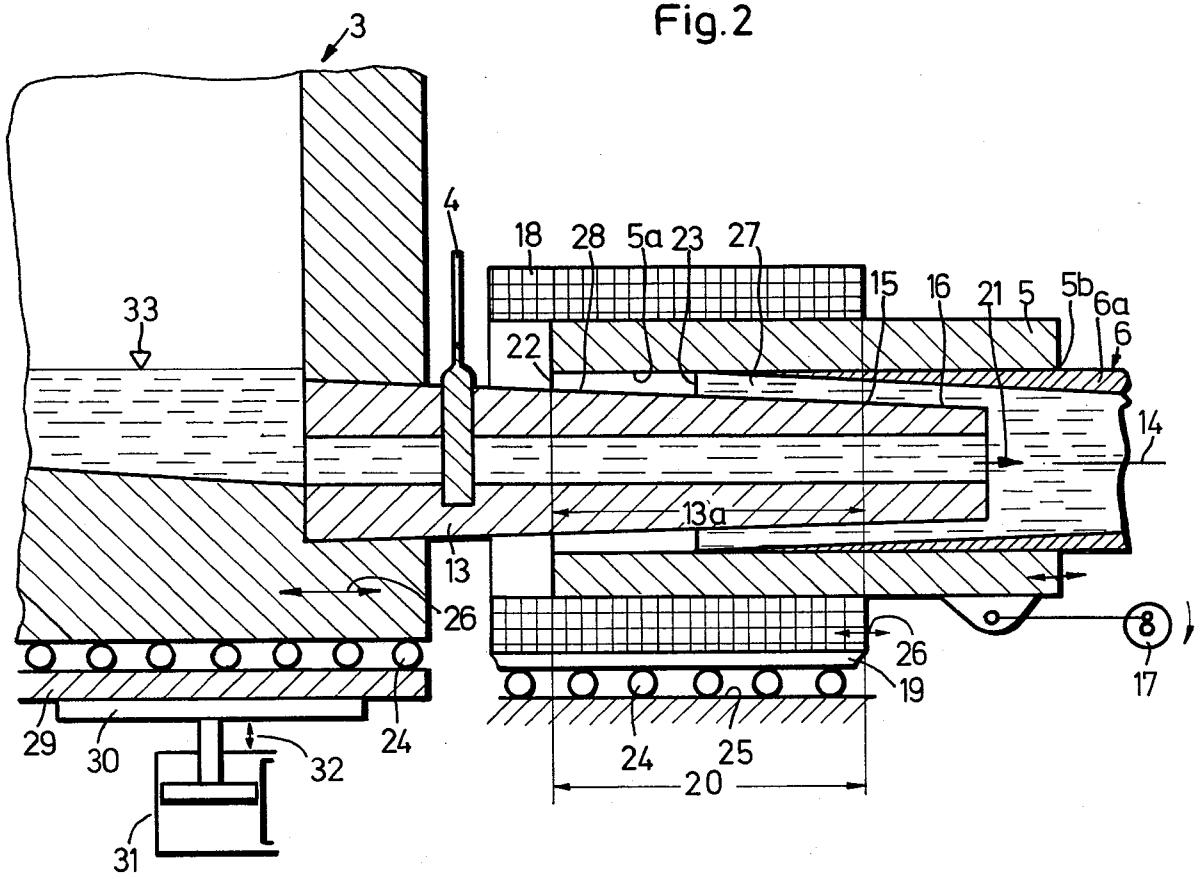
FIG. 2 is a partial vertical cross sectional view through the storage container, horizontal continuous casting iron-cast mold, and magnetic coil.

As best seen in FIG. 2, the storage container 3 is provided with a drain pipe 13, extending horizontally into the interior of the horizontal continuous casting cast-iron mold 5. The length of the drain pipe 13 is inversely proportioned to the quantity of liquid casting metal fed per unit time into the storage container 3. Thus, the greater the quantity sought to be continuously cast by the continuous casting installation the shorter the necessary length of drain pipe 13 extending into the horizontal continuous casting cast iron mold 5. Conversely, the smaller the quantity desired to be continuously cast by the continuous casting installation, the longer the necessary length of drain pipe 13 extending into the mold 5. The length of the drain pipe 13, on the other hand, is directly proportioned to the specific parameters of the horizontal continuous casting cast-iron mold 5.

Drain pipe 13 is provided with a steadily tapered shape, i.e., its exterior surface tapers down toward the downstream direction of the installation. The degree of the taper is dependent upon the cooling intensity applied in the horizontal continuous casting cast-iron mold 5 and also is dependent upon the expected strand-shell formation **6*a*. The strand formation 6*a* forms an acute angle configuration with respect to the metal strand axis 14. As an alternative to the uniformly tapered outer contour 15 of drain pipe 13, a stepped taper shape can be provided at the opening area 16 of drain pipe 13. The drain pipe 13** is preferably manufactured of refractory material similar to that which is conventionally used for the manufacture of quenching nozzles for the molds of continuous-casting installations.

The horizontal continuous casting cast-iron mold 5 is made of copper and is provided with a water-cooling mechanism (not shown). The mold 5 is reciprocatingly moved, i.e., upstream and downstream with respect to the entire installation, concentrically with respect to the strand axis 14, by means of an oscillating drive 17. The oscillating movement of the mold serves to continuously detach the casting strand 6 from the interior surface **5*a* of the mold 5, thereby substantially eliminating ruptures of the metal skin within the mold 5**.

An electro-magnetic coil 18 is also arranged concentrically with respect to both the metal strand axis 14 and around the horizontal continuous casting cast-iron mold 5. The magnetic coil 18 is, in one embodiment of the invention, secured to the rigid or oscillating horizontal continuous casting cast-iron mold 5 or (as illustrated) it is mounted on a separate support frame 19. In either case, the coil 18 and mold 5 are provided with the necessary electrical and fluid connections for supplying electrical energy and cooling water.

The magnetic coil 18 overlaps a longitudinal section 20 of mold 5 and also overlaps longitudinal section **13*a* of the drain pipe 13 extending into mold 5. The concentric longitudinal sections of (a) the magnetic coil 18; (b) the continuous casting cast-iron mold 5; and (c) the drain pipe 13, are arranged in the context of the present invention, with a degree of overlap and practically form an "electric valve", which prevents liquid metal from flowing back, i.e., upstream, counter to the preferred direction of casting strand flow 21**.

To further insure that liquid metal does not inadvertently escape rearwardly through mold 5, the magnetic coil 18 extends by a certain length backwardly beyond the rearmost end of the horizontal continuous casting cast-iron mold 5 which, during the metal casting operation, is open at opening 22. The length of the rearmost extension of the magnetic coil 18 can be selectively altered, depending on the location of the trailing edge 23 of the liquid metal. To this end, the magnetic coil 18 is adjustable by means of cylindrical rollers 24 which ride on a horizontally extending track 25. Thus, the magnetic coil is able to move parallel to the strand axis 14 in both directions indicated by arrows 26. After proper adjustment of magnetic coil 18, the electro-inductive force generated by the electrically coupled magnetic coil 18 will be concentrated on the annular ring 27 of the liquid metal strand 6 which is formed between the inner wall surface 5*a* of the horizontal continuous casting cast-iron mold 5 and the outer wall surface 28 of the drain pipe 13.

Further adjustability of the trailing end 23 of liquid metal strand 6 can be accomplished by adjusting the projection of the drain pipe 13 into the mold 5. Drain pipe 13, which is directly secured to the storage container 3, can be horizontally adjusted by movement of storage container 3. As illustrated, the storage container 3 is supported on rollers 24 which glide on track 29 and is relatively horizontally adjustable, thereby adjusting the extension of drain pipe 13 into the mold 5 and magnetic coil 18 in both of the directions indicated by arrows 26.

Track 29 for rollers 24 is supported on a hoisting platform 30 which is upwardly and downwardly adjustable in both of the vertical directions indicated by arrows 32 by means of a hydraulic hoisting drive 31. The height adjustability enables the axis of the drain pipe 13 to be centrally located on the strand axis 14, i.e., the axes can be coaxially arranged. During the metal casting operation, it may be desirable to adjust the drain pipe 13 either horizontally with respect to mold 5 or vertically with respect to strand axis 14 in order to produce desired flow characteristics of the liquid metal within the horizontal continuous casting cast-iron mold 5.

In operation, the continuous casting installation functions as follows: At the beginning of the casting process, the exit orifice 5*b* of the horizontal continuous casting cast-iron mold 5 is closed by a conventional starting strand cap and sealed by means of sealants. The closure 4 is also closed (as illustrated in FIG. 2). Molten metal is then tapped from the casting ladle into the storage container 3. As soon as the casting metal flows from the casting ladle 1 into the storage container 3 and a casting level 33 is established in the storage container 3, the level being at least at the height of the uppermost inner surface wall 5*a* of the horizontal continuous casting cast-iron mold 5, the closure 4 is opened and the magnetic coil 18 is energized. The trailing end 23 of the metal strand 6 is thereby formed. The casting strand 6 is then pulled out by means of the driving structure 8, such that the tension is initially transmitted to the starting strand. Toward the end of this initial production phase, the electrical or induction forces of the magnetic coil 18 are continuously electrically controlled, depending on the height of the casting level 33, thereby preventing backflow of the metal strand. The controls for the drive mechanism (not shown) of (a) the storage container 3, (including drain pipe 13), (b) the magnetic coil 18 in the directions 26, and (c) hoisting drive 31 in the vertical directions 32 can also, if desired, be included in the control of the electrical coil 18.

As casting continues, the level of the liquid metal in the storage container is continuously monitored and adjusted so that it does not fall below the height of the uppermost inside wall surface 5*a* of mold 5. This adjustment of the level of the liquid metal can be performed by either adding additional liquid metal or by raising the storage container 3, being sure, however, not to block the drain pipe 13 by the bottom of the storage container 3.

Alternatively, the level of liquid metal in the storage container 3 can be maintained at a fixed multiple, greater than 1, of the cross section diameter of the mold 5, above the lowermost inside wall surface 5*a* of mold 5.

It will be appreciated that other embodiments of the present invention can be constructed without departing from the teaching of the present invention, the invention being defined by the scope of the appended claims and equivalents thereof.

I claim:

1. A method for horizontal continuous casting of liquid metal, in which the liquid metal in the horizontal continuous casting mold is subjected to both the gravitational force of the liquid metal held in a storage container and electromagnetic forces generated by a magnetic coil along the direction of casting, comprising the steps of:

(a) passing said liquid metal from said storage container through a drain pipe and directly into said casting mold, said drain pipe having a discharge end extending into said casting mold and serving to prevent said liquid metal from contacting air prior to said liquid metal entering said casting mold, said drain pipe and casting mold being substantially horizontally adjustable with respect to one another, (b) continuously maintaining the level of the liquid metal in said storage container at a height at least as high as the uppermost inside wall surface of said horizontal continuous casting mold, (c) continuously regulating the location of said electromagnetic coil along the direction of casting so that said electromagnetic coil overlays both at least the upstream end of said horizontal continuous casting mold and the trailing end of said liquid metal in said casting mold, (d) continuously drawing the cooling cast metal strand from said casting mold, (e) maintaining, by adjusting said electromagnetic coil and said level of liquid metal, the location of said trailing end of said liquid metal so that said trailing end is located within said casting mold and said magnetic coil, and (f) maintaining said trailing end of said liquid metal open to the atmosphere.

2. A method for horizontal continuous casting as claimed in claim 1, wherein said uppermost inside wall surface of said horizontal continuous casting mold is located at the upstream opening of said horizontal continuous casting mold.

3. A method for horizontal continuous casting as claimed in claim 1, wherein said electro-magnetic forces, normal in size for the desired casting velocity, are first adjusted to an amount higher than the equilibrium force required for maintaining the trailing end of said liquid metal, after which said electro-magnetic forces are subsequently regulated to the desired casting velocity.

4. A method for horizontal continuous casting as claimed in claim 1, wherein said step (b) is accomplished by the addition of liquid metal to said storage container.

5. A method for horizontal continuous casting as claimed in claim 1, wherein said step (b) is accomplished by the relative vertical movement of said storage container with respect to said continuous casting mold.

6. A method for horizontal continuous casting as claimed in claim 1, wherein said step (c) is accomplished by relative horizontal movement of the magnetic coil.

7. A method for horizontal continuous casting as claimed in claim 1, wherein said step (c) is accomplished by relative horizontal movement of said storage container and said drain pipe.

8. A method for horizontal continuous casting as claimed in claim 1, wherein step (e) is accomplished by relative horizonal movement of the storage container with respect to the magnetic coil.

9. A method for horizontal continuous casting as claimed in claim 1, wherein step (e) is accomplished by relative horizontal movement of the magnetic coil with respect to said continuous casting mold.

10. A horizontal continuous liquid metal casting apparatus comprising:

(a) a storage container for receiving a bulk quantity of liquid metal, (b) a horizontally projecting continuous casting mold located adjacent to said storage container, (c) a drain pipe capable of transferring liquid metal from said storage container into the interior of said horizontal continuous casting mold without said liquid metal becoming exposed to the atmosphere before cooling in said casting mold, (d) said drain pipe being freely movable with respect to said casting mold and extending from said storage container at least partially into said horizontal continuous casting mold, (e) an electrically activatable magnetic coil, having a section overlapping at least a portion of both of said horizontal continuous casting mold and said drain pipe the forces of said magnetic coil being adjustable in the horizontal direction of said casting mold, and (f) a portion of said magnetic coil extends at least partially upstream of said casting mold.

11. A horizontal continuous casting apparatus as claimed in claim 10, wherein said portion of said drain pipe overlapped by said magnetic coil is inside said horizontal continuous casting mold.

12. A horizontal continuous casting apparatus as claimed in claim 10, wherein said magnetic coil is provided with means for adjustably locating said magnetic coil along the strand axis directions.

13. A horizontal continuous casting apparatus as claimed in claim 10, wherein the outer surface of said drain pipe and the interior surface wall of said horizontal continuous casting mold form an annular ring-shaped slot.

14. A horizontal continuous casting apparatus as claimed in claim 10, wherein said drain pipe is provided with a tapered exterior wall surface.

15. A horizontal continuous casting apparatus as claimed in claim 14, wherein said tapered exterior wall surface of said drain pipe tapers down in the downstream direction.

16. A horizontal continuous casting apparatus as claimed in claim 10, wherein said storage container is provided with means for selectively adjusting the relative horizontal position of said storage container along the strand axis directions.

17. A horizontal continuous casting apparatus as claimed in claim 10, wherein said storage container is provided with means for selectively adjusting the relative vertical position of said storage container with respect to said continuous casting mold.

18. A horizontal continuous casting apparatus as claimed in claim 10, wherein said storage container is a distribution vessel for a multi-strand continuous casting installation, said distribution vessel being provided with at least two drain pipes extending therefrom, each of said drain pipes being associated with a horizontal continuous casting mold to provide multi-strand continuous casting.

* * * * *